US005729907A

United States Patent [19]

Santhouse et al.

[11] Patent Number: 5,729,907

[45] Date of Patent: Mar. 24, 1998

[54] HAIR STRAIGHTENING PICK

[75] Inventors: Daniel Santhouse, Wilton; R. Niel Tobin, Stamford, both of Conn.; Joseph J. Beuschel, Monsey, N.Y.

[73] Assignee: Conair Corporation, Stamford, Conn.

[21] Appl. No.: 722,481

[22] Filed: Sep. 27, 1996

[51] Int. Cl.[6] ..... A45D 21/00

[52] U.S. Cl. ..... 34/98

[58] Field of Search ..... 34/96, 97, 98, 34/101; 132/118, 271; 392/380

[56] References Cited

U.S. PATENT DOCUMENTS

| | | | |
|---|---|---|---|
| 3,840,030 | 10/1974 | Baker | 132/118 |
| 3,853,133 | 12/1974 | Komatsu et al. | 132/11 |
| 3,903,905 | 9/1975 | Tucker | 132/118 |
| 3,939,850 | 2/1976 | Wahl | 132/11 |
| 4,230,279 | 10/1980 | Forsberg | 34/97 X |
| 4,308,670 | 1/1982 | Bonnema | 34/97 |
| 4,759,135 | 7/1988 | Scivoletto | 34/97 |
| 4,766,291 | 8/1988 | Collins | 219/534 |
| 4,827,105 | 5/1989 | Brown, Jr. | 219/373 |
| 4,955,145 | 9/1990 | Scivoletto | 132/271 |
| 5,091,630 | 2/1992 | Djuric | 219/222 |

*Primary Examiner*—Henry A. Bennett
*Assistant Examiner*—Steve Gravini
*Attorney, Agent, or Firm*—Ohlandt, Greeley, Ruggiero & Perle

[57] ABSTRACT

An attachment for a hair dryer includes an upper body for supporting a heat transmissive plate with a comb extending from one side of the heat transmissive plate and a lower body for attachment to an outlet of the hair dryer. The heat transmissive plate is heated by the hot air exiting the hair dryer's outlet. The upper body of the attachment includes vents positioned about the heat transmissive plate for directing heated air generally in front of and behind the heat transmissive plate, and a pair of side vents for directing heated air to the sides of the heat transmissive plate. The lower body of the attachment may include a plurality of inner ribs positioned at its internal surface or a plurality of flexible inner segments situated within the internal surface, either of which serve to attach the lower body to the hair dryer outlet. The hair dryer attachment thus provides a simple means for using a hair dryer to dry and straighten one's hair.

9 Claims, 6 Drawing Sheets

HAIR STRAIGHTENING PICK

FIELD OF THE INVENTION

The present invention relates to hair styling products for use with hair dryers and the like. More particularly, the present invention relates to a hair dryer attachment that includes a hair straightening pick and air outlets positioned about the pick for drying hair and venting excess air.

BACKGROUND OF THE INVENTION

A variety of different methods may be used for straightening hair. For example, the user may employ a hair brush to place tension on his or her hair while applying heated air with a hair dryer. In particular, the user gathers a portion of hair and extends it away from his or her head. The extended hair portion is then treated with heated air to enable it to retain its extended shape. However, the above method is a two-handed procedure that requires agility, concentration and, thus, can be strenuous and tiresome for the user.

Other methods for straightening hair include (i) applying a relaxing agent to break down the natural curls of the hair and (ii) compressing the hair between flat surfaces of a heated iron. A hair dryer is typically used to dry the hair and, in some cases, provides the requisite heat necessary to activate the relaxing agent.

SUMMARY OF THE INVENTION

Against the foregoing background, it is a primary object of the present invention to provide an attachment for a hair dryer that dries the user's hair while straightening the hair.

It is another object of the present invention to provide a hair dryer/straightener attachment that straightens the user's hair by drawing the hair across a heated surface.

It is a further object of the present invention to provide a hair dryer/straightener attachment that permits the user to dry his or her hair while the attachment is positioned on the hair dryer.

It is a still further object of the present invention to provide a hair dryer/straightener attachment that may be used with high volume, concentrated air flow dryers.

Accordingly, an attachment for a hair dryer includes an upper body for supporting a heat transmissive plate with a comb extending from one side of the plate and a lower body for attachment to an outlet of the hair dryer. The heat transmissive plate is heated by the hot air exiting the hair dryer's outlet. The upper body of the attachment includes vents positioned about the heat transmissive plate for directing heated air generally in front of and behind the heat transmissive plate, and a pair of side vents for directing heated air to the sides of the heat transmissive plate. The lower body of the attachment may include a plurality of inner ribs positioned at its internal surface or a plurality of flexible inner segments situated within the internal surface, either of which serve to attach the lower body to the hair dryer outlet. The hair dryer attachment thus provides a simple means for using a hair dryer to dry and straighten one's hair.

BRIEF DESCRIPTION OF THE DRAWINGS

The foregoing and still further objects and advantages of the present invention will be more apparent from the following detailed explanation of the preferred embodiments of the invention in connection with the accompanying drawings.

DETAILED DESCRIPTION OF THE PREFERRED EMBODIMENTS

Figure 1:
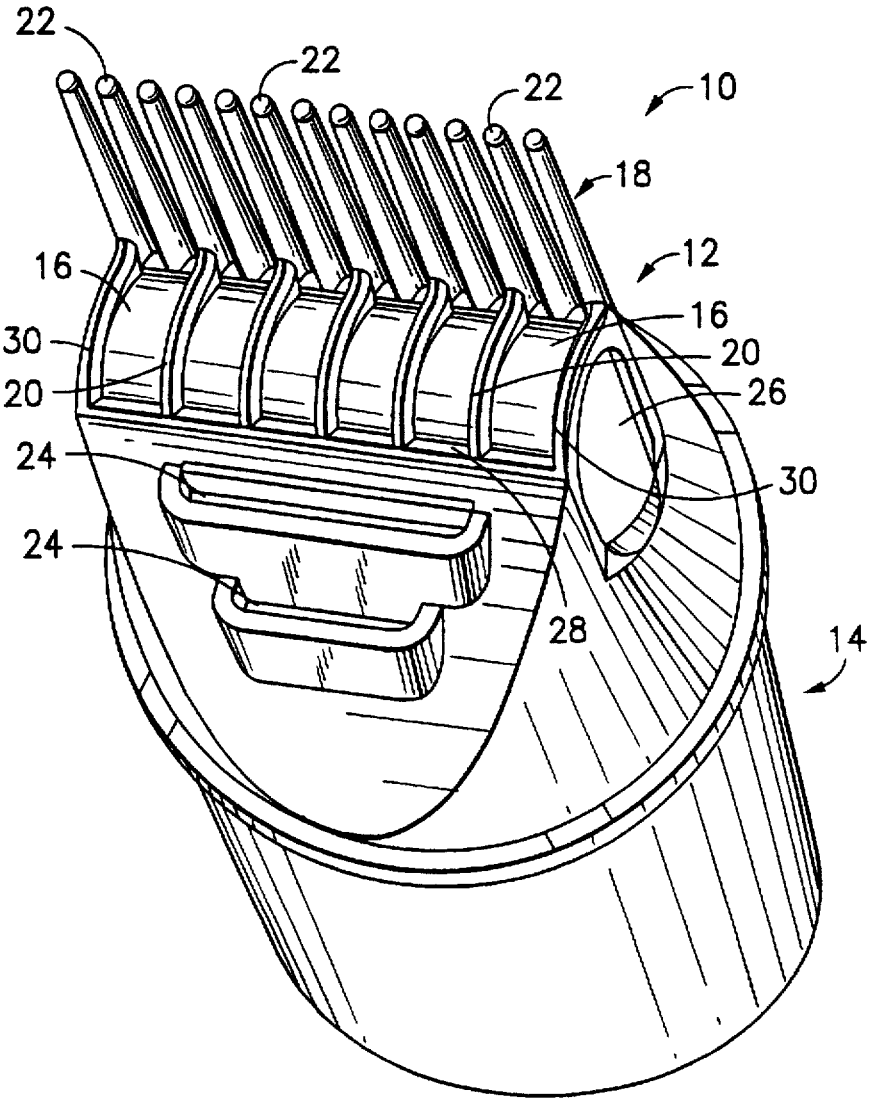
FIG. 1 is a perspective view of the first preferred embodiment in accordance with the present invention.

Referring to FIG. 1, there is illustrated a first preferred embodiment of a hair dryer attachment 10. The first preferred embodiment is a two-part attachment that comprises an upper body 12 for supporting the hair straightening elements and a lower body 14 for securing upper body 12 to a front nozzle or outlet of a hair dryer (not shown). Upper body 12 may be detached from lower body 14 for various reasons, such as for cleaning the inner compartment of the attachment or may be integral with lower body 14. Both upper body 12 and lower body 14 are comprised of an appropriate polymeric material.

The hair straightening elements of upper body 12 include a heat transmissive plate 16 and a comb 18. Heat transmissive plate 16 is comprised, preferably, of a type of material that is capable of absorbing heat from the hot air produced by the hair dryer and transmitting the absorbed heat to the user's hair (e.g. metal, a heat conducting polymer such as a talc-filled nylon, a metal filled polycarbonate, etc.). As shown in FIG. 1, heat transmissive plate 16 is laterally curved so that the hair may glide over its upper surface. Also, heat transmissive plate 16 is situated on upper body 12 such that plural spaced ridges 20 are positioned in front of the upper surface of heat transmissive plate 16. Ridges 20 are spaced so that neither the user's scalp nor fingers can come into contact with heat transmissive plate 16. Comb 18 includes a plurality of teeth 22 that weave through the user's hair and pull the hair to create tension so that the hair is drawn across heat transmissive plate 16. Thus, the tension of pulling the user's hair straightens the hair, and the action of drawing the hair across heat transmissive plate 16 causes the hair to retain its straightened form.

Figure 2:
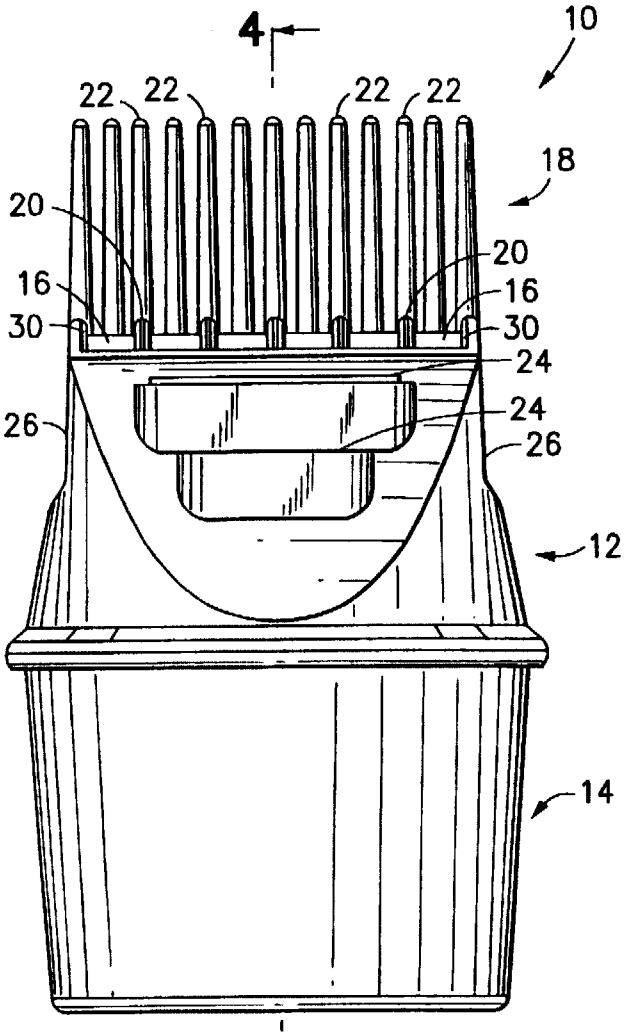
FIG. 2 is a front view of the first preferred embodiment of FIG. 1.
Figure 3:
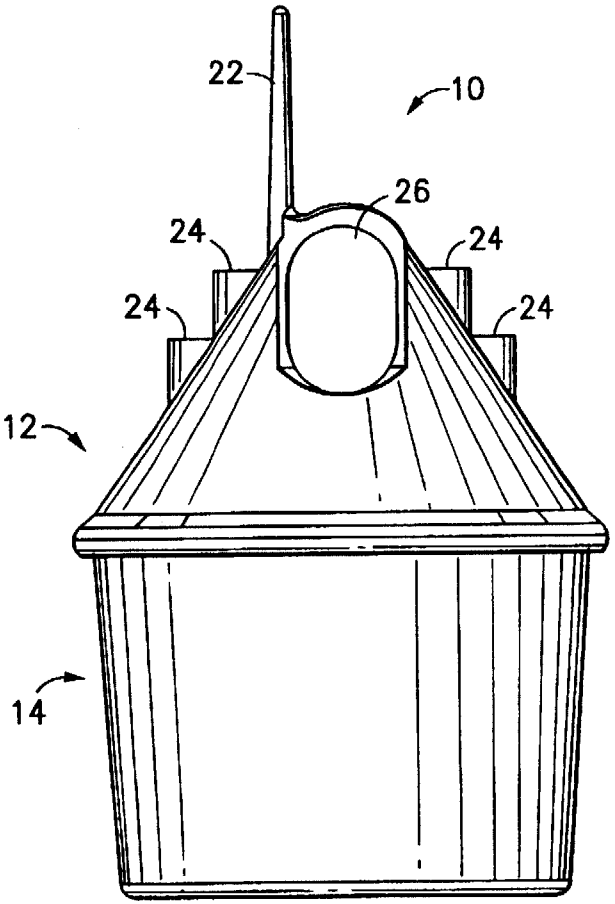
FIG. 3 is a side elevational view of the first preferred embodiment of FIG. 1.

Referring to FIGS. 1, 2 and 3, upper body 12 of the first preferred embodiment includes vents 24 and side vents 26. Vents 24 are positioned on opposed sides of upper body 12 and direct heated air to areas both in front of and behind attachment 10 along an intended direction of use. Side vents 26 are positioned on both longitudinal sides 30 of heat transmissive plate 16 and are used for directing heated air out the sides of attachment 10. For the first preferred embodiment, two vents are positioned adjacent to each either side of heat transmissive plate 16 and side vents 26 are positioned to each longitudinal end 30 of heat transmissive plate 16. Accordingly, attachment 10 of the present invention performs a dual action, namely the heated air from vents 24 effectively dries the user's hair as the hair is drawn across heat transmissive plate 16 by comb 18.

Side vents 26 provide attachment 10 with the ability to be used with a wide variety of different hair dryers. Many conventional hair dryers have high powered fans that produce high volume, concentrated air flows. Excessive obstruction of the hair dryer's front outlet or nozzle can produce mechanical problems for such hair dryers. Side vents 26 of attachment 10 provide substantial venting capabilities and, thus, attachment 10 may be used with a wide variety of different hair dryers, regardless of the speed or power of the hair dryer's fan. Also, side vents 26 permit the user to dry his or her hair while attachment 10 is still attached to the hair dryer.

Figure 4:
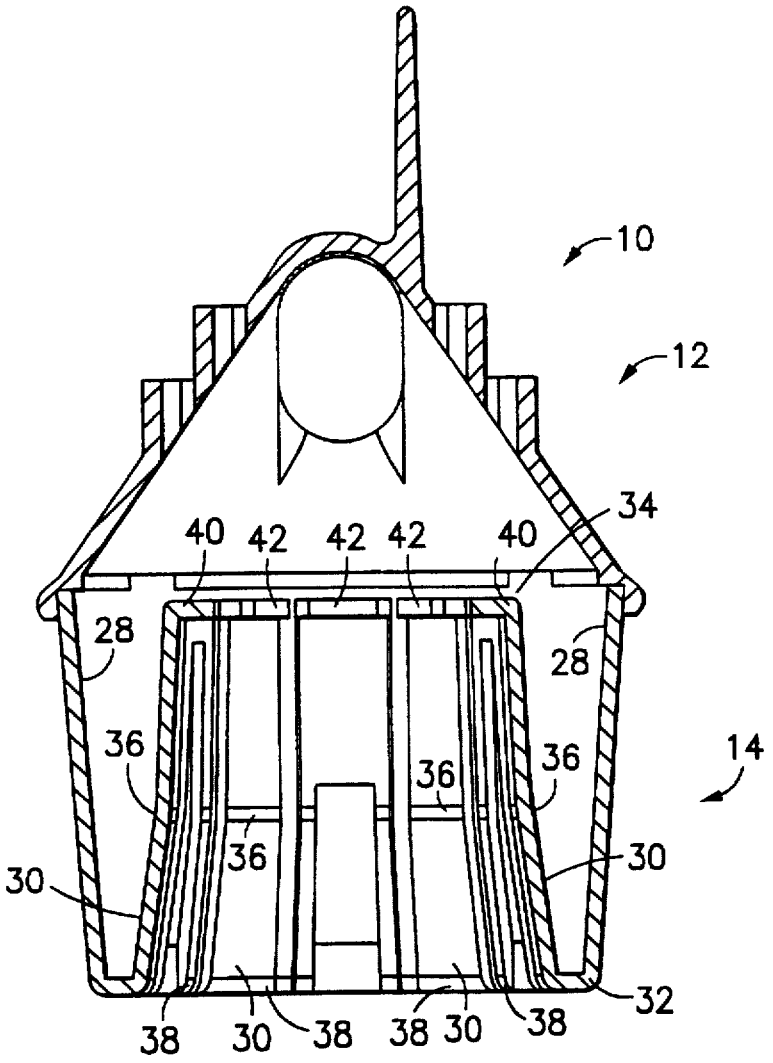
FIG. 4 is a sectional view of the first preferred embodiment taken along line 4—4 of FIG. 2.

Referring to FIG. 4, lower body 14 of the first preferred embodiment attaches to a nozzle or outlet of a hair dryer. In particular, lower body 14 has an internal surface 28 and a plurality of inner, flexible segments 30 situated within internal surface 28. Each inner segment 30 has a substantially elongated shape and is angled inward from bottom 32 to top 34 of lower body 14. Also, for the first preferred embodiment, the angle of incline for each inner segment changes at a mid-point 36 of inner segment 30.

Each inner segment 30 has a lower end 38 that is connected to the bottom of lower body 14, and an upper end 40 that positioned at top 34 of lower body 14, such that upper end 40 of each inner segment 30 is free to adjust toward and away from internal surface 28 of lower body 14. In addition, each inner segment 30 includes a shoulder 42 at its upper end 40 for abutting the end portion of the hair dryer's outlet or nozzle. Therefore, the dynamic adjustability of inner segments 30 provides for adjustable attachment to the outlet or nozzle of a wide variety of different hair dryers.

Figure 5:
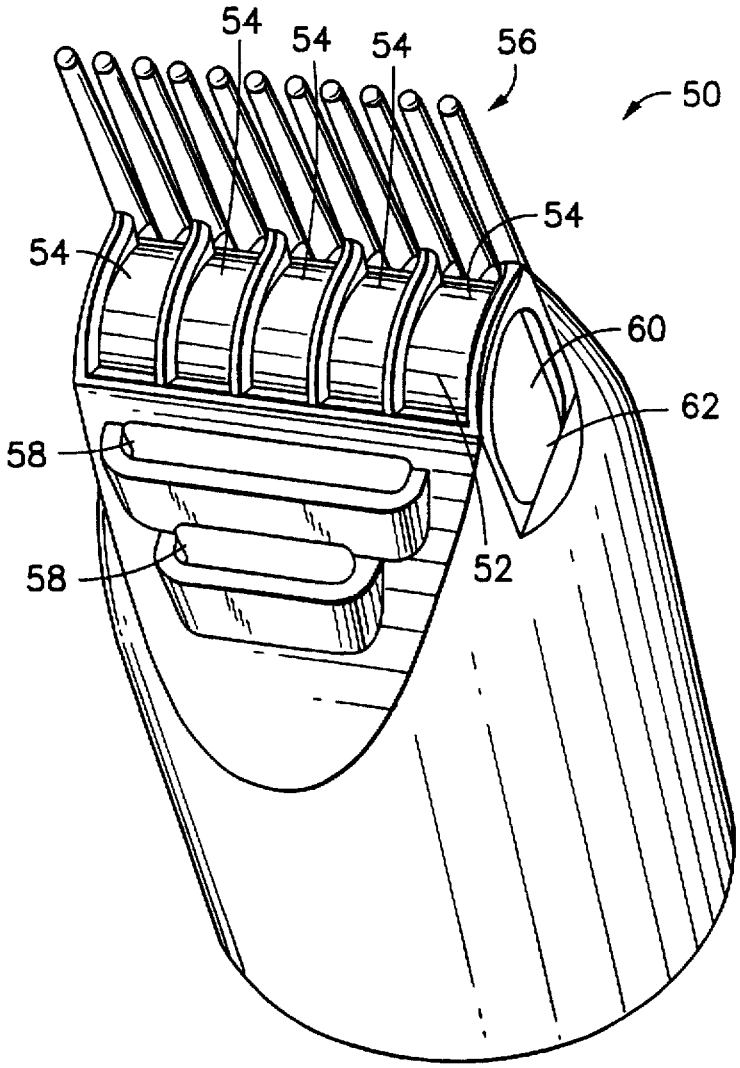
FIG. 5 is a perspective view of the second preferred embodiment in accordance with the present invention.
Figure 7:
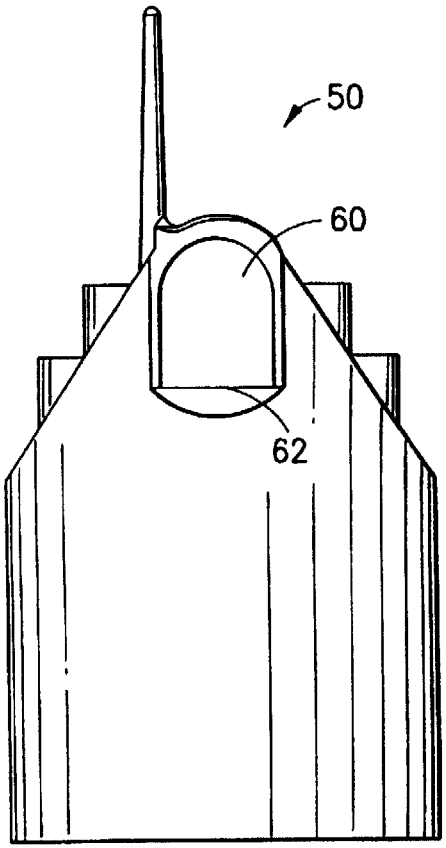
FIG. 7 is a side elevational view of the second preferred embodiment of FIG. 5.
Figure 6:
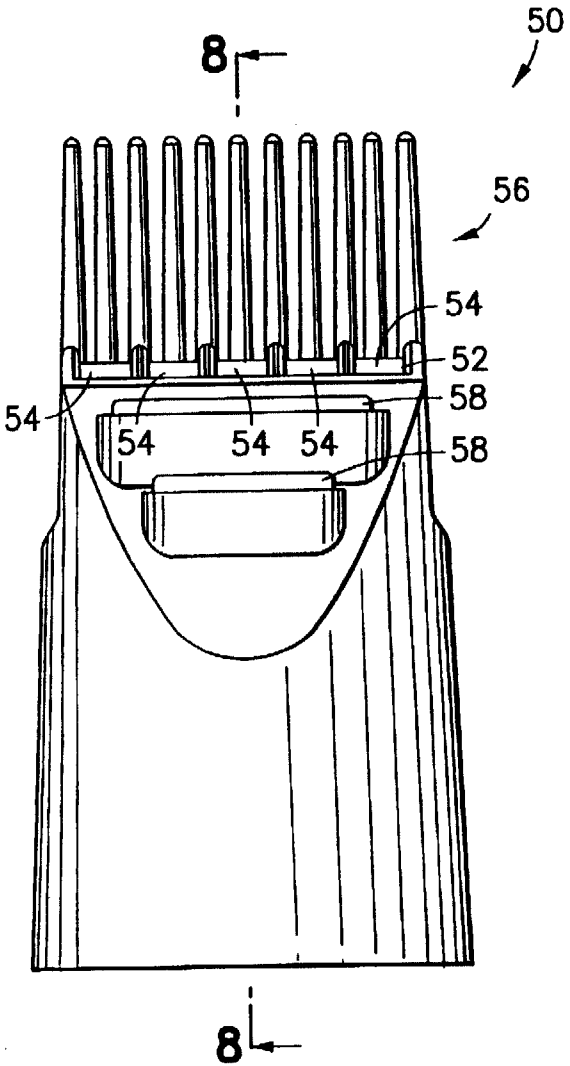
FIG. 6 is a front view of the second preferred embodiment of FIG. 5.

Referring to FIGS. 5 through 8, there is shown a second preferred embodiment of the hair dryer attachment 50 in accordance with the present invention. As shown in FIGS. 5 through 7, the second preferred embodiment is a one-piece attachment that is circumferentially narrower than the two-part attachment of the first preferred embodiment. Also, forward vents 58 are larger, thus providing for greater venting of air flow therethrough.

Figure 8:
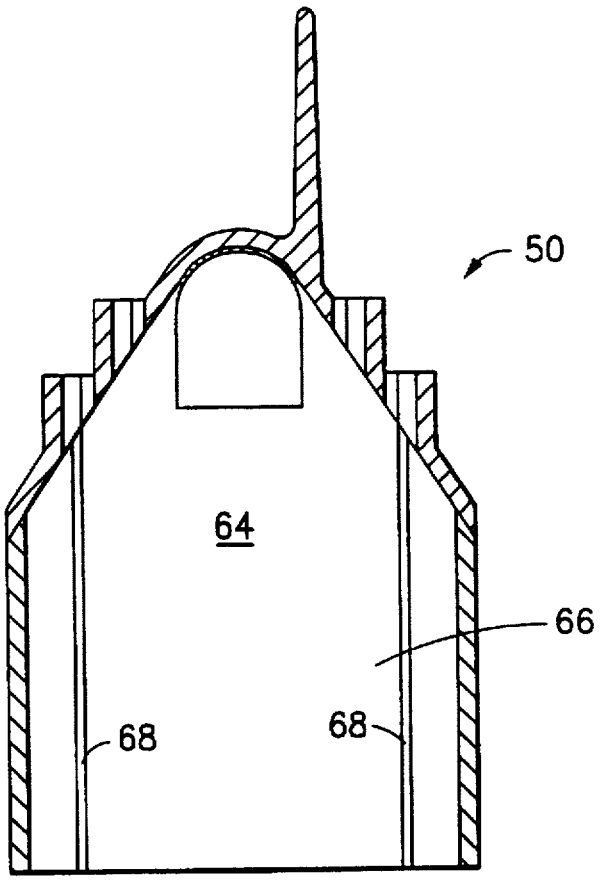
FIG. 8 is a sectional view of the second preferred embodiment taken along line 8—8 of FIG. 6.

Referring to FIG. 8, inner compartment 64 of the second preferred embodiment does not include the inner segments 30 of the first preferred embodiment, shown in FIG. 4. Instead, inner compartment 64 includes an internal surface 66 having inner ribs 68 that secure attachment 50 to the outlet or nozzle of the hair dryer. In addition, as stated above, the general circumference of the second preferred embodiment is narrower than that of the first preferred embodiment. Accordingly, inner ribs 68 and the narrower circumference of the second preferred embodiment adequately secures attachment 50 to many types of hair dryers.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An attachment for a hair dryer comprising:

a heat transmissive plate having an extended longitudinal dimension and a transverse dimension, a convex upper surface and a lower surface;

attachment means for coupling said heat transmissive plate to an air outlet of the hair dryer, said attachment means including air vents generally aligned with said longitudinal dimension for directing air flow along an axis traveled by heated air which exits from said hair dryer and about said heat transmissive plate, heated air produced by the hair dryer impacting on said lower surface and causing a heating of said heat transmissive plate; and a comb extending from said attachment means and having a plurality of substantially parallel teeth, said comb positioned with respect to said heat transmissive plate so that when said attachment is joined to said air outlet and is drawn through a user's hair, said hair is tensioned, brought into contact with said convex upper surface and is heated thereby.

2. The attachment of claim 1, wherein said attachment means includes plural, spaced, insulating fingers positioned on said convex upper surface for preventing a user's skin from contacting said heat transmissive plate.

3. The attachment of claim 1, wherein:

at least one of said air vents in said attachment means, is positioned to one side of said heat transmissive plate for directing said heated air along said axis; and at least a second one of said air vents in said attachment means positioned to an opposed side of said heat transmissive plate, for directing said heated air along said axis.

4. The attachment of claim 1, further comprising at least one side vent positioned in said attachment means, at an end of said lateral dimension of said heat transmissive plate, for directing heated air in a direction transverse to a side of said attachment means.

5. The attachment of claim 4, wherein a pair of side vents are positioned in said attachment means, at opposed ends of said lateral dimension of said heat transmissive plate, for directing heated air in a direction transverse to opposed sides of said attachment means.

6. The attachment of claim 1, wherein said attachment means includes an internal surface having inner ribs that secure said attachment means to said outlet of said hair dryer.

7. The attachment of claim 1, wherein the attachment means includes an internal surface and a plurality of inner segments situated within said internal surface for attachment to said air outlet of said hair dryer.

8. The attachment of claim 7, wherein one end of each of said inner segments is connected to a lower end of said attachment means, such that said inner segments are capable of flexibly adjusting toward and away from said internal surface of said attachment means.

9. The attachment of claim 1, wherein said heat transmissive plate is comprised of metal.

* * * * *